United States Patent [19]

Waite

[11] 3,930,765

[45] Jan. 6, 1976

[54] ROTARY DISPLACEMENT PUMPS

[76] Inventor: William Edmund Waite, Molex Limited, The Trading Estate, Farnham, Surrey, England

[22] Filed: Feb. 11, 1974

[21] Appl. No.: 441,322

[30] Foreign Application Priority Data

Feb. 9, 1973 United Kingdom ..... 6605/73

[52] U.S. Cl. ..... 418/48

[51] Int. Cl.[2] ..... F04C 1/06; F04C 17/06

[58] Field of Search ..... 418/48

[56] References Cited

UNITED STATES PATENTS 3,340,814 9/1967 Streicher ..... 418/48

FOREIGN PATENTS OR APPLICATIONS 909,116 10/1962 United Kingdom ..... 418/48

622,583 5/1949 United Kingdom ..... 418/48

*Primary Examiner*—C. J. Husar
*Assistant Examiner*—L. J. Casaregola
*Attorney, Agent, or Firm*—Young & Thompson

[57] ABSTRACT

A rotary positive displacement pump of the internally-meshing screw type having a stator, a rotor and an inlet or outlet chamber at one end of the rotor has a drive comprising a connecting member rigidly secured to the rotor and extending through the chamber, which connecting member, beyond the end of the chamber remote from the rotor, is joined by a connecting rod with two universal joints to a drive shaft, connecting member in the chamber being supported by a bearing flexibly carried on a resilient support member which is sealed to the outer race of the bearing and also to the chamber wall.

3 Claims, 1 Drawing Figure

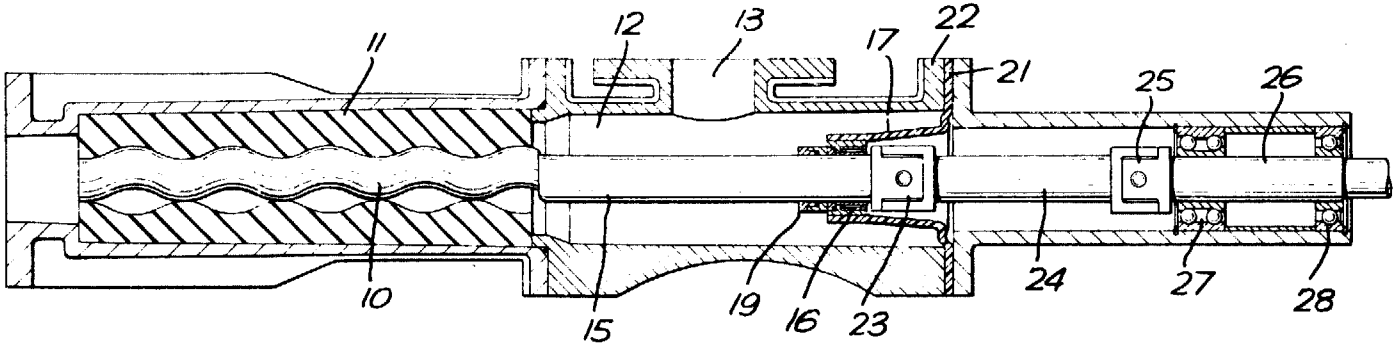
11
12
13
22
21
17
25
26
28
10
15
19
16
23
24
27

ROTARY DISPLACEMENT PUMPS

BACKGROUND OF THE INVENTION

1. Field of the Invention

This invention relates to rotary positive displacement pumps of the internally-meshing screw kind in which a helical rotor, e.g., a member of circular section formed into a helix or a member having an external helical shape, is rotated inside a stator with a rounded helical groove, the rotor longitudinal axis being radially offset from the stator longitudinal axis and the rotor and stator being co-operatively shaped so that the rotor has moving contact with the stator around the helical groove in the stator to form a displacement pump. Such a pump is well-known and will hereinafter be referred to as a rotary positive displacement pump of the internally-meshing screw kind.

2. Prior Art

The stator of such a pump is usually formed of an elastomer, such as a hard rubber, whilst the rotor is preferably of metal. In a pump of this kind, the rotor does not turn about its axis but has to be moved around a circular path as it rotates. It is therefore the common practice to drive such rotor from a drive shaft by means of a connecting shaft which is coupled at one end by a first universal joint to one end of the rotor and is coupled at its other end by a second universal joint to the drive shaft. Since the material to be pumped has to pass axially through the stator from one end to the other, the connecting shaft with the universal joints is commonly in the inlet or outlet chamber for the fluid being pumped. This causes problems when particulate material, particularly abrasive material has to be pumped; flexible protective covering have to be provided for the universal joints.

SUMMARY OF THE INVENTION

It is an object of the present invention to provide an improved form of rotary positive displacement pump of the internally-meshing screw kind in which the universal joints are isolated from the fluid being pumped.

According to the present invention, in a rotary positive displacement pump of the internally meshing screw kind having a stator, a rotor and an inlet or outlet chamber at one end of the stator, a connecting member is rigidly secured to the rotor and extends into said chamber, the connecting member, near its end remote from the rotor, passing through a bearing, which bearing is carried in a resilient support member extending completely around and sealed to the bearing, the support member being sealed also to the wall of said chamber, the connecting member at the end beyond said bearing being connected by a first universal joint to a connecting rod connected by a second universal joint to a drive shaft. The resilient support member is conveniently of the general form of a frustum of a cone with its smaller end sealed to the bearing and its wider end sealed to the wall of the chamber.

With this construction, the rotor and connecting member can turn and move around the required circular path, the resilient member flexing to permit the bearing to move around this circular path. Preferably a seal is provided around the connecting member adjacent the bearing to prevent any ingress of fluid along the shaft into the bearing. It will be seen that, by this construction, the universal joints are protected from any ingress of material being pumped. The chamber around the connecting member provides a substantially unobstructed path for the fluid to enter or leave the stator. The rotary movement of the connecting member prevents the chamber in the region of the entry to (or exit from) the stator becoming clogged when pumping a fluid containing large particles.

The resilient support member is formed of neoprene rubber or other suitable material. Preferably, for sealing this resilient member to the chamber, it is shaped to have an annular flange which is clamped between an end member of the chamber and an end flange on an annular wall of the chamber.

BRIEF DESCRIPTION OF THE DRAWING

The accompanying drawing is a diagrammatic section through a pump constituting one embodiment of the invention.

DESCRIPTION OF THE PREFERRED EMBODIMENT

Referring to the drawing there is shown an eccentric worm positive displacement pump having a helical rotor 10, conveniently formed of metal, which rotor is located within a stator 11 formed of an elastomer such as a hard rubber. The rotor, at any one point along its point, is of circular section but is shaped to form a helix and is rotated inside a stator having a rounded helical groove, the rotor axis being offset from the stator axis in the known way so that the rotor, as it is rotated and moved in a circular path, has moving contact with the stator along the helical groove to form a displacement pump.

In this particular embodiment, the rotor is driven from the inlet end although it will be readily apparent that it could equally well be driven from the outlet end. At the inlet end of the stator, there is a cylindrical inlet chamber 12 connected to an inlet port 13. Extending through this chamber is a connecting member 15 rigidly secured to the rotor. This connecting member is of circular form but is parallel to but offset from the axis of the chamber. The member 15, near the end remote from the rotor 10, is carried in a bearing 16. This bearing 16 is supported in a resilient mount 17 having the general form of a frustum of a cone, the narrower end of the mount being sealed to the outer bearing race. A sealing member 19 is provided around the connecting member 15 adjacent the end of the bearing 16 to prevent any ingress of fluid into the bearing 16 along the connecting member 15. At its wider end, the conical resilient member 17 has an outwardly directed flange 21 which is clamped between a flange 22 on the end of an annular wall of the chamber 12 and an end plate for the chamber so as to form a fluid-tight seal between the member 17 and the wall of the chamber. Beyond the bearing 16, the connecting member 15 is connected by a first universal joint 23 to a connecting shaft 24 which in turn is connected by a second universal joint 25 to a drive shaft 26 in bearings 27, 28. It will be seen that, with the construction described, the two universal joints 23, 25 are completely sealed from the fluid in the inlet chamber 12. In this chamber 12, the connecting member 15 moves around a circular path permitting large particles to pass freely into the pump. The movement of the connecting member 15 helps to prevent any possibility of clogging the region around the inlet to the stator 11.

I claim:

1. In a rotary positive displacement pump of the internally-meshing screw kind having a stator, a rotor and a chamber at one end of the stator the chamber being defined by a surrounding wall; the improvement comprising drive means for the rotor comprising an elongated connecting member of circular cross section, one end of said member being rigidly secured to the rotor and extending into said chamber, a bearing for said connecting member within said chamber, the connecting member, near its end remote from the rotor, passing through said bearing, a resilient support member for said bearing, said resilient support member being liquid-impermeable and having the form of a frustum of a cone extending completely around and having its smaller end sealed to the bearing, the support member at its larger end being sealed also to the wall of said chamber thereby to form a fluidtight barrier between the bearing and said wall of the chamber, a drive shaft, first and second universal joints, and a connecting rod between said universal joints, said connecting member at the end beyond said bearing being connected by said first universal joint to said connecting rod, which connecting rod is connected by said second universal joint to said drive shaft, said chamber being elongated, said connecting member being secured to the rotor at one end of said chamber, said bearing being disposed at the other end of said chamber, and an inlet for material to be pumped opening into said chamber between said bearing and said one end of said chamber, said connecting member having a length to diameter ratio greater than three and extending at least most of the length of said chamber.

2. A pump as claimed in claim 1 wherein a seal is provided around the connecting member adjacent the bearing to prevent any ingress of fluid along the shaft into the bearing.

3. A pump as claimed in claim 1 wherein said chamber is of generally cylindrical form and has an annular wall with an end flange at the end remote from said rotor and wherein an end wall extends at least partly across that end of said chamber, said end wall having an aperture for said drive means, and wherein said resilient support member has an annular flange which is clamped between said end wall and said end flange on said annular wall of the chamber.

* * * * *